United States Patent [19]

Haas

[11] 4,353,609

[45] Oct. 12, 1982

[54] TERMINAL FOR PRINTED CIRCUIT BOARDS

[75] Inventor: Richard M. Haas, Phoenix, Ariz.

[73] Assignee: Henes Products Corp., Phoenix, Ariz.

[21] Appl. No.: 193,382

[22] Filed: Oct. 2, 1980

[51] Int. Cl.[3] ..... H01R 9/09; H01R 13/428

[52] U.S. Cl. ..... 339/17 C; 339/217 S; 339/278 T

[58] Field of Search ..... 339/17 R, 17 C, 17 LC, 339/217 S, 278 T; 361/404, 405

[56] References Cited

U.S. PATENT DOCUMENTS 2,533,483 12/1950 Losquadro ..... 339/217 S 3,118,716 1/1964 Brellier ..... 339/217 X 4,129,351 12/1978 Sugimoto et al. ..... 339/217 S

FOREIGN PATENT DOCUMENTS 2009378 9/1971 Fed. Rep. of Germany ... 339/17 LC 2845402 4/1980 Fed. Rep. of Germany .... 339/17 C 1209719 10/1970 United Kingdom ..... 339/217 S

*Primary Examiner*—Neil Abrams

*Attorney, Agent, or Firm*—Warren F. B. Lindsley

[57] ABSTRACT

An improved spade type terminal for mounting on a printed circuit board, the terminal utilizing a special construction that prevents it from falling out of the board during or prior to the soldering process.

2 Claims, 6 Drawing Figures

TERMINAL FOR PRINTED CIRCUIT BOARDS

BACKGROUND OF THE INVENTION

Nearly all electronic circuits currently in manufacture utilize printed circuit boards for the mounting and electrical interconnection of semiconductors and other circuit elements or components such as resistors, capacitors, etc. These boards are made from a stock material comprising a base of insulating material such as paper or glass epoxy having a thin sheet of copper cemented or bonded to one or both sides thereof. The base material of the board is typically from one-sixteenth to one-eighth of an inch thick with the copper runs comprising one to ten mils in thickness. The copper conductor patterns are formed by means of a photo-etching process that removes the unwanted copper from between conductor runs. After the etching process has been completed, holes are drilled through conductor pads for the mounting of the electrical components. An additional plating process usually follows to form conductive surfaces through the drilled holes. The plated-through holes permit a better and more reliable solder bond between the conductor runs and the terminals of the electrical components.

The next step in the manufacture of the printed circuit board involves the mounting of components. The individual components are mounted on the board by inserting the leads or terminals of the components through the plated-through holes. This operation is done either manually or by automated means.

Finally, these leads or terminals are soldered in place, typically by means of an automated process in which the underside of the board and the protruding leads and terminals are passed across the surface of a molten bed of solder. The molten solder is drawn up into the plated-through holes by capillary action and solidifies when the board is withdrawn from the solder bed.

DESCRIPTION OF THE PRIOR ART

Power connections to printed circuit boards are often made by means of connectors, one part of which is soldered to the printed circuit board. A widely used connector of this type is commonly referred to as a spade connector. A first member of this connector is soldered to the board and comprises a rectangular body that extends either perpendicularly to or at an oblique angle with the surface of the board. External connections are made to this connector by means of a wire secured to a second member of the connector which is shaped to be slipped over the first member and securely held thereto by a gripping action of the second member.

In some instances, the board mounted first member is employed along as a solder terminal. In this case, a wire is soldered directly to the extended body of the first member and this method is facilitated by a small hole being provided in the body of the first member through which this wire may be passed prior to soldering.

In the assembly of the space connector to the printed circuit board, the board-mounted portion or member of the connector has a tendency to become dislodged and fall off of the circuit board prior to the soldering operation.

Further, the use of the board-mounted member of the connector as a soldering terminal often creates a second problem. Because the body of the first member of the connector is a good thermal conductor, heat carried by this member to the printed circuit board during the soldering of the external wire thereto tends to melt the solder joint at the surface of the board or cause other damage to the board and its mounted parts.

The present invention is directed toward the correction of both of these problems through the provision of an improved spade-type connector for printed circuit board use.

SUMMARY OF THE INVENTION

In accordance with the invention claimed, an improved connector for printed circuit board use is provided which overcomes the deficiencies and problems of the prior art connectors.

It is, therefore, an object of the present invention to provide an improved spade type connector for use on printed circuit boards.

Another object of the present invention is to provide such a connector in a form that holds itself securely in place on the printed circuit board prior to and during the soldering operation.

A still further object of the invention is to provide such a connector in a form that has a significantly reduced tendency to conduct heat to the printed circuit board when an external conductor is soldered to the connector.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
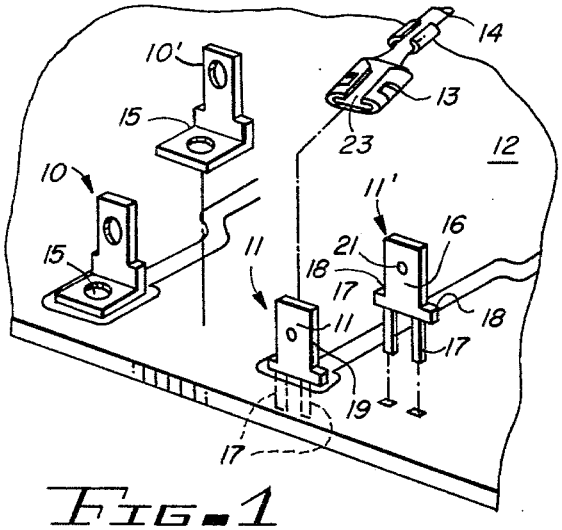
FIG. 1 (PRIOR ART)
FIG. 1 is a perspective view of a printed circuit board together with two types of prior art connectors currently in use for making electrical connections to such boards.
Figure 2:
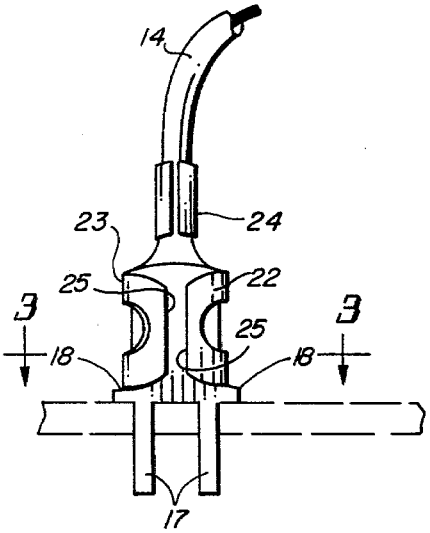
FIG. 2 (PRIOR ART)
FIG. 2 is an enlarged perspective view of one of the prior art connectors of FIG. 1 showing the mounting of a first member of the connector to the printed circuit board and the attachment of a second member to the first member.
Figure 3:
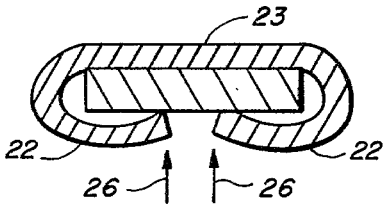
FIG. 3 (PRIOR ART)
FIG. 3 is a cross-sectional view of FIG. 2 taken along line 3—3.

Referring more particularly to the drawing by characters of references, FIGS. 1–3 illustrate two prior art quick-disconnect connectors currently used for making electrical connections to printed circuit boards.

As shown in FIG. 1, the two prior art connectors comprise first members 10 and 11, respectively, which are mounted on a printed circuit board 12 and a second member 13, one connectable with each of the first members, which is attached electrically and mechanically to an electrical conductor 14. Members 10 and 11 are each designed to receive the second member 13 in mating relationship therewith.

Member 10 is simply an "L" shaped bracket formed by bending a rectangular strip of metal perpendicularly across its approximate center. The lower portion of member 10 is pierced at its center to provide a hole 15 through which a rivet or an eyelet may be passed for securing member 10 to the printed circuit board 12. With the lower portion thus secured in a flush arrangement against the surface of the printed circuit board, the upper portion of member 10 will extend substantially perpendicularly thereto or in some other predetermined oblique angular arrangement with the surface of the board.

Because of the riveting process or the installation of an eyelet the use of this type of connector is a time-consuming operation. Member 11 is frequently employed as a labor-saving alternative and is also formed from a flat sheet of conductive material.

As shown more clearly in the exploded position of members 10 and 11, member 11 comprises a rectangular body 16 having two slender legs 17 extending perpendicularly from its lower edge and a pair of small wings or tabs 18 extending outward from its sides. Legs 17 are spaced apart so that each leg comprises a downward coplanar extension of one of the opposite vertical sides 19 of body 16. Tabs 18 are positioned just above the junctions of legs 17 and body 16. Member 11 is mounted to board 12 by inserting legs 17 through two appropriately dimensioned and spaced-apart plated-through holes in the printed circuit board 12 and is permanently secured therein by means of a soldering operation. The wings 18 enhance the mechanical stability of member 11 and provide increased soldering surface area.

Both members 10 and 11 of the connectors shown have their body portions extending laterally from the circuit board and pierced to provide a hole 21 through which an electrical conductor may be passed for soldering. As mentioned earlier, however, the relatively heavy metal body of these members has a tendency to carry an excessive amount of heat to the board 12 during the soldering of external wires thereto.

The second member 13 of the connectors, as shown in FIGS. 1–3, is commonly employed in the prior art. This member is formed from conductive metal to slide over the first members 10 and 11 in mating relationship therewith. Members 10 and 11 serve the function of a male member and members 13 serve the function of a female member for this form of connector. Wings 22 extending outwardly from a rectangular center area 23 of member 13 fold around the sides of members 10 and 11. A conductor grip 24 extends upwardly from the upper edge of area 23 of member 13 which is crimped around the end of conductor 14 to form a secure electrical and mechanical connection thereto. Wings 22 folding around the edges of members 10 and 11 meet at approximately the center thereof. The mutually confronting edges 25 of wings 22 are bent back toward the surface of area 23 so that when member 13 is installed over members 10 and 11 the wings 22 and their edges 25 make a pressure contact with the members 10 and 11. The pressure applied by edges 25 of wings 22 of member 13 is represented in FIG. 3 by arrows 26.

The combination of member 13 with members 10 and 11 forms an effective quick-disconnect printed circuit board connector, but the means for attaching members 10 and 11 to board 12 leave something to be desired. Member 10 requires a riveting or an eyelet operation and member 11 has a tendency to fall off the board prior to soldering.

To overcome the thermal conduction and board attachment problems associated with connector members 10 and 11, an improved connector or connector member 27 is provided in accordance with the stated objects of the present invention.

Figure 4:
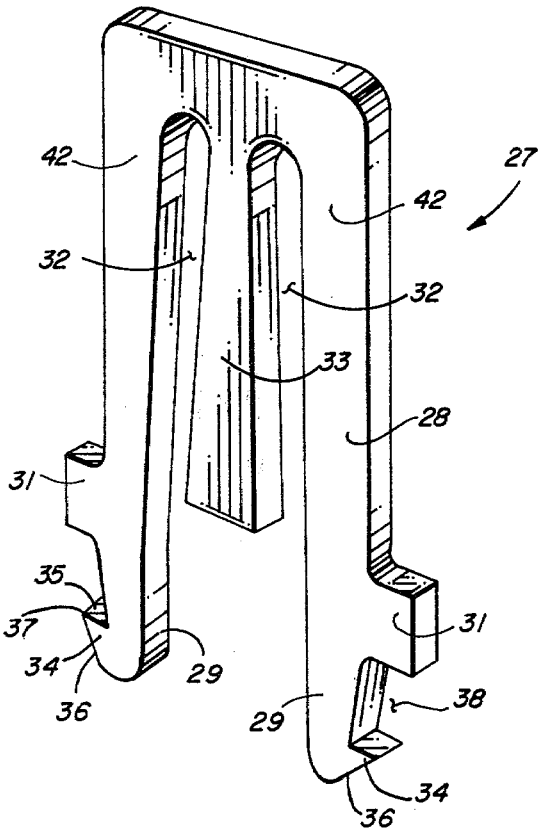
FIG. 4 is a perspective view of an improved connector embodying the invention.
Figure 5:
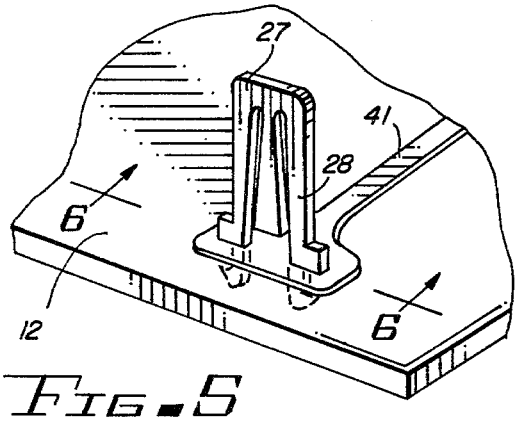
FIG. 5 is a perspective view of the connector of FIG. 4 mounted on a printed circuit board.
Figure 6:
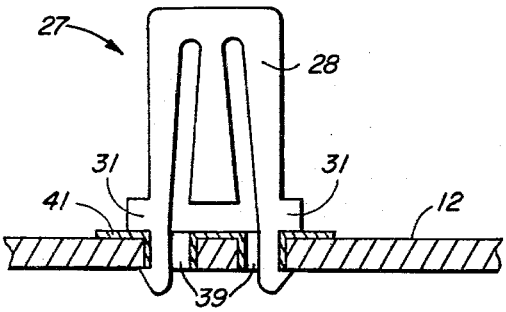
FIG. 6 is a cross-sectional view of FIG. 5 taken along line 6—6.

As shown in FIGS. 4–6, member 27 comprises a slotted, generally rectangular body 28 having two coplanar legs 29 extending laterally from the lower left and right-hand corners as shown in these figures. Two tabs 31 extend outwardly from body 28 one from the left-hand edge and the other from the right-hand edge thereof. These tabs 31 are located just above the points of attachment of legs 29 to a circuit board 12.

The slotted rectangular body 28 of member 27 is formed in the shape of an upper-case letter E turned on its face with the three arms of the E extending downwardly toward the surface of the associated circuit board. This spaced arrangement of the arms of body 28 is formed by two spacedly arranged slots 32 extending longitudinally of one end of body 28 to a point just short of the other end of body 28. These slots 32 slightly converge in the preferred embodiment with the result that the center arm 23 of the E-shaped configuration is wider at its free end and tapers to a narrower width at the bite of the E-shaped configuration.

Whereas the legs 17 of connector member 11 of the prior art are of a uniform width dimension, the legs 29 of member 27 are provided with outwardly projecting hooks or toes 34 at their lower extremities. Each of these hooks has a horizontal upper surface 35 and a canted lower surface 36, the two surfaces 35 and 36 intersecting at their outer extremities to terminate at a point 37.

The upper surface 35 of each hooks 34 forms with the lower surface of the tab 31 located directly above it a rectangular opening or indentation 38 of an appropriate dimension for receiving the thickness dimension of board 12.

As shown in FIGS. 5 and 6, when member 27 is mounted on board 12 with legs 29 inserted through plated-through holes 39, legs 29 are sufficiently spread apart so that the edge of board 12 in the region of holes 39 is firmly gripped within the indentations 38 of member 27. Hooks 34 prevent member 27 from falling off circuit board 12. This gripping action is assured through the spacing of holes 39 in circuit board 12 sufficiently close together so as to require that legs 29 of member 27 must be compressed or pushed together during their installation into holes 39. Releasing the compression force allows the legs to spring apart as the indentations 38 receive therein the edges of board 12 at the outer edges of holes 39. To remove the legs 29 of member 27 from the holes 39 it is merely necessary to compress or pinch the legs together during such removal operation.

Following the installation of member 27, as just described, a soldering operation is implemented to assure a sound electrical and mechanical bond between legs 29 of member 27 and the plated-through holes 39 of circuit board 12 which, in turn, are electrically continuous with the conductive copper run 41 on the surface of circuit board 12.

When connector member 13 is installed over member 27 in the same manner that it is installed over the prior art members 10 and 11, the edges 25 of member 13 impinge against center arm 33 of the E-shaped configuration of member 27 to achieve a firm and secure electrical and mechanical connection therebetween.

If a conductor is soldered directly to the top portion of connector member 27, the narrow, thermally conductive paths 42 extending longitudinally of legs 29 toward the surface of circuit board 12 present significantly higher thermal resistances to the flow of heat from the spaced end of member 27 to the surface of circuit board 12 as compared with the corresponding thermal resistances of the prior art members 10 and 11. As a result, considerably less heat is carried to circuit board 12 during such a soldering operation.

Both the mechanical and the thermal problems associated with the prior art connector members 10 and 11 are thus effectively eliminated in the improved connector or connector member 27 in accordance with the stated objects of the invention.

Although but a single embodiment of the invention has been illustrated and described, it will be apparent to those skilled in the art that various changes and modifications may be made therein without departing from the spirit of the invention or from the scope of the appended claims.

What is claimed is:

1. A connector for a printed circuit board comprising:

a relatively flat member having a substantially E-shaped configuration, said E-shaped configuration comprising three arms, two of which form substantially identical leg members extending longitudinally of said member along opposite edges thereof, the third arm of said E-shaped configuration being shorter in length than the other two arms and tapering from its free end to a narrower width at the bite of the E-shaped configuration, said third arm lying in a coplanar arrangement with said other two arms and spaced therefrom by two substantially equally configured slots extending from the free end of said third arm along opposite edges thereof toward the other end of said member, the free ends of said legs being notched along said opposite edges of said member for receiving therein a portion of the edges of plated-through holes in an associated circuit board when said legs of said member are mounted thereon, the opposed edges of the free ends of said legs being canted outwardly from their ends longitudinally therealong, and the E-shaped configuration, when mounted to said board, being formed to slidably receive thereabout, a female clip with bent over arms, the third arm of the connector providing continuous flat surface means for secure electrical engagement with said bent over arms.

2. The connector set forth in claim 1 wherein:

said slots converge from the free end of said third arm along opposite edges thereof toward the other end of said member.

* * * * *